US005918888A

United States Patent [19]

Pellegrini, Jr. et al.

[11] Patent Number: 5,918,888

[45] **Date of Patent: *Jul. 6, 1999**

[54] BRAKING DEVICE PARTICULARLY FOR SKATES

[75] Inventors: Alfred Pellegrini, Jr., Montebelluna; Andrea Tormena, Crocetta Del Montello, both of Italy

[73] Assignee: Nordica S.p.A., Trevignano, Italy

[ * ] Notice: This patent is subject to a terminal disclaimer.

[21] Appl. No.: 08/473,437

[22] Filed: Jun. 7, 1995

Related U.S. Application Data

[63] Continuation of application No. 08/115,416, Sep. 1, 1993, Pat. No. 5,465,984.

[30] Foreign Application Priority Data

| | | | |
|---|---|---|---|
| Sep. 1, 1992 | [IT] | Italy | TV92A0097 |
| Nov. 11, 1992 | [IT] | Italy | TV92A0136 |
| Nov. 30, 1992 | [IT] | Italy | TV92A0150 |
| Jan. 14, 1993 | [IT] | Italy | TV93A0001 |

[51] Int. Cl.[6] ..... A63C 17/14

[52] U.S. Cl. ..... 280/11.2; 188/5; 280/11.22

[58] Field of Search ..... 280/11.2, 11.22; 188/5, 6, 7

[56] References Cited

U.S. PATENT DOCUMENTS

| | | | |
|---|---|---|---|
| 920,848 | 5/1909 | Eubank | 280/11.2 |
| 922,774 | 5/1909 | Kennedy | 280/11.23 |
| 926,646 | 6/1909 | Eubank | 280/11.2 |
| 979,169 | 12/1910 | Kennedy | 280/11.2 |
| 1,402,010 | 1/1922 | Ormiston | 280/11.2 |
| 1,445,048 | 2/1923 | Spross | 280/11.2 |
| 1,497,224 | 6/1924 | Ormiston | 280/11.2 |
| 1,687,739 | 10/1928 | Slusher | 280/11.2 |
| 2,179,592 | 11/1939 | Goettie | 280/11.2 |
| 3,767,220 | 10/1973 | Peterson | 280/11.2 |
| 4,033,596 | 7/1977 | Andorson et al. | 280/11.2 |
| 4,275,895 | 6/1981 | Edwards | 280/11.2 |
| 5,052,701 | 10/1991 | Olson | 280/11.2 |
| 5,088,748 | 2/1992 | Koselka et al. | 280/11.2 |
| 5,232,231 | 8/1993 | Carlsworth | 280/11.2 |
| 5,253,882 | 10/1993 | Mitchell | 280/11.2 |
| 5,439,238 | 8/1995 | Neal | 280/11.2 |
| 5,486,012 | 1/1996 | Olivieri | 280/11.2 |
| 5,487,552 | 1/1996 | Daoust | 280/11.2 |

*Primary Examiner*—Robert J. Oberleitner
*Assistant Examiner*—Michael Mar
*Attorney, Agent, or Firm*—Hale and Dorr LLP

[57] ABSTRACT

Braking device for skates including an item of footgear composed of a quarter articulated to a shell which is in turn associated with a supporting frame for one or more wheels. The device includes a rod member connected to the quarter and is slidingly associated with the shell. The rod member has an end which, upon a rotation of the quarter, pushes toward the ground, a braking element articulated to the frame.

12 Claims, 10 Drawing Sheets

BRAKING DEVICE PARTICULARLY FOR SKATES

This is a division of application Ser. No. 08/115,416, Sep. 1, 1993 and now U.S. Pat. No. 5,465,984 issued Nov. 15, 1995.

BACKGROUND OF THE INVENTION

The present invention relates to a braking device particularly usable for skates which comprise an item of footgear composed of a quarter articulated to a shall which is in turn associated with a supporting frame for one or more wheels.

Currently, in known roller skates, whether constituted by an item of footgear associated with a support for two pairs of mutually parallel wheels or by an item of footgear associated with a supporting frame for one or more aligned wheels, the problem is felt of braking said wheels in order to adjust the speed of said skate.

It is thus known to use adapted blocks or pads, usually made of rubber, which are arranged at the toe or heel regions of the item of footgear; when the user tilts the item of footgear forwards or backwards, the free end of the pads or blocks interacts with the ground and braking is thus achieved.

However, these solutions are not optimum, since they require the user to rotate the item of footgear, and therefore the frame associated therewith, at the toe or heel, and this can be the cause of losses of balance with consequent falls.

U.S. Pat. No. 1,402,010 is also known; it discloses a roller skate provided with a band which can be secured on the user's leg above the malleolar region and to which a rod is connected.

Said rod wraps around the leg to the rear and is then curved so as to laterally affect the leg until it is associated, at its ends, in the malleolar region, with a lever system which is articulated to a flap protruding from the wheel supporting frame.

Said lever system protrudes to the rear of the frame and is connected to a plate which is shaped approximately complementarily to the curvature of part of an underlying and facing wheel.

This solution is not free from drawbacks: first of all, a relative movement occurs between the band and the leg throughout sports practice, and this does not make its use comfortable.

Furthermore, the plate is activated every time the user bends his leg backwards beyond a given angle, without actual and easy possibilities of varying this condition.

Furthermore, each user has a specific leg shape, and braking is thus obtained at different rotation angles for equal lengths of the rod.

Furthermore, said rod rests and presses on the malleolar region, and this can cause discomfort or accidental impacts.

Finally, considerable wear of the wheel is observed.

U.S. Pat. No. 4,275,895 is known as a partial solution to this drawback; it discloses a brake for skates with two pairs of mutually parallel wheels, which acts at the rear wheels.

Said brake is constituted by a flap associated with the item of footgear in a rearward position; a blade is associated with said flap in a rearward position and is pivoted at the supporting frame for the item of footgear.

Said blade has, at its free end, a transverse element on which a pair of C-shaped elements is formed at the lateral ends; said elements interact, following a backward rotation imparted to the flap, with the rear wheels which face them, so as to interact with the rolling surface of said wheels.

However, even this solution has drawbacks: it is in fact structurally complicated and thus difficult to industrialize; it furthermore entails the presence of adapted springs suitable to allow the flap to return to the position in which the pair of C-shaped elements does not interact with the wheels, and this further increases structural complexity.

Furthermore, the structural configuration of the brake causes the pair of C-shaped elements to interact with the wheel even upon a minimal backward rotation imparted to the flap and thus even due to involuntary movements, and this produces unwanted braking actions and therefore possible situations of loss of balance or lack of coordination.

Finally, interaction of the C-shaped element at the rolling surface of the wheels leads to rapid wear of said wheels and thus to non-optimum rolling, which necessarily entails continuous wheel replacement.

U.S. Pat. No. 4,300,781 is also known; it relates to a braking device for skates which comprise pairs of mutually parallel wheels.

It furthermore comprises a brake constituted by a blade pivoted transversely at the rear end of the supporting frame for an item of footgear; pads facing the rolling surface of the pair of rear wheels are associated with the ends of said blade.

The brake is activated by using a cable suitable to impart a rotation to the blade in contrast with a spring associated with the support for the pair of front wheels, so as to move the pads into contact with the rolling surface of the pair of rear wheels.

The cable can be activated by means of rings or handles associated with a band which can be arranged on the legs of the user by virtue of the presence of temporary connection means.

However, this solution has considerable drawbacks; first of all, activation of the brake can lead to possible losses of coordination during sports practice, since the user has to perform an uncoordinated movement.

Furthermore, during the traction applied to the rings the band may disengage from the legs, thus thwarting the braking action.

In any case, there is a loose cable which can accidentally catch during racing, especially since coordination of the arm-legs movement causes the legs to be located rhythmically laterally toward the outside.

SUMMARY OF THE INVENTION

The aim of the present invention is therefore to eliminate the drawbacks described above in known types by providing a braking device for skates which is structurally very simple and easy to industrialize.

Within the scope of the above aim, an important object is to provide a braking device which can be activated by the user in case of actual need and thus not accidentally.

Another important object is to provide a braking device which can be deactivated rapidly and simply by the user.

Another important object is to provide a device wherein brake activation can be preset by the user according to his own specific requirements, whether related to the shape of the leg or to the particular type of sport being practiced.

Another object is to provide a device which protects the rolling surface of the wheels against wear.

Another object is to obtain a device which associates with the preceding characteristics that of being reliable and safe in use, has low manufacturing costs and can also be applied to known skates.

This aim, these objects and others which will become apparent hereinafter are achieved by a braking device as disclosed in the attached claims.

BRIEF DESCRIPTION OF THE DRAWINGS

Further characteristics and advantages of the present invention will become apparent from the detailed description of preferred embodiments, illustrated only by way of non-limitative example in the accompanying drawings, wherein.

DESCRIPTION OF THE PREFERRED EMBODIMENTS

Figure 1:
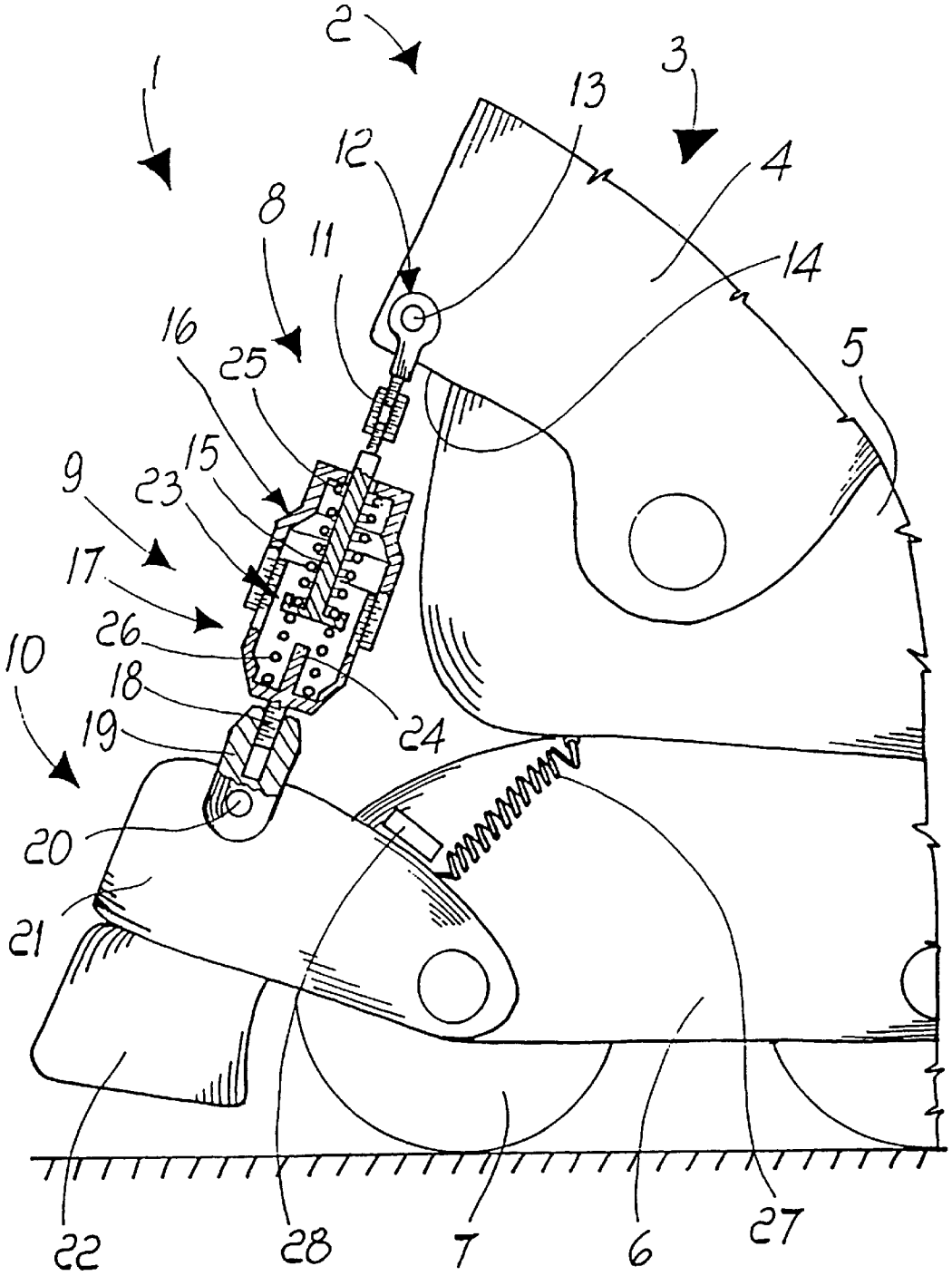
FIG. 1 is a partially sectional side view of the braking device associated with a skate.

With reference to the above figures, the reference numeral 1 designates the braking device, particularly usable for skates designated by the reference numeral 2.

Said skates comprise an item of footgear 3 composed of a quarter 4 which wraps around the rear lateral region of the user's leg and is articulated to a shell 5; a frame 6 is associated with said shell in a downward region and supports one or more wheels, designated by the reference numeral 7, which are preferably mutually aligned.

Adapted fastening levers for the quarter 4 and the shell 5 may be also added.

The braking device comprises a first rod member 8 and a second rod member 9 which are respectively connected to said quarter 4 and to a braking element 10 which is oscillatably articulated to said frame 6 or at the pivot of one of said wheels 7.

The first rod member 8 and the second rod member 9 interact with adapted first and second means suitable to adjust their working length; said first means are constituted by an internally threaded cylinder 11 with which complementarily threaded stems of a first bush 12 interact; said first bush is pivoted, by means of a first pivot 13, proximate to the lower perimetric edge 14 Of the quarter 4 in the rear region thereof; the other threaded stem protrudes axially with respect to a shaft 15; the assembly thus composed constitutes, in this case, said first rod member 8.

Said first rod member is slidingly contained within a first sleeve 16 which is internally hollow and has a perforated end for the passage of said shaft 15 and an internally threaded end.

A complementarily threaded end of a second sleeve 17 interacts with said internally threaded end; said sleeve 17 is internally hollow and rigidly coupled to said second rod member 9.

The second sleeve 17 in fact has, on the side opposite to the end which interacts with the first sleeve 16, a threaded stem 18 protruding axially toward the braking element 10 and interacting with the second means suitable to adjust the working length of the second rod member 9, which are constituted by a second bush 19 having an adapted and complementarily threaded axial seat and being transversely pivoted, by means of a second pivot 20, to a support 21 which constitutes said braking element 10 and the wings whereof are pivoted, at their ends, to the frame 6 at the pivot of one of said wheels 7.

At least one pad 22 which interacts with the ground is associated below the support 21.

The shaft 15 has a head 23, inside the first sleeve 16, which is essentially T-shaped and faces a tab 24 which protrudes axially inside the second sleeve 17.

The purpose of the tab 24 is to act as stroke limiter for the compression of the spring 26, forcing the lowering of the braking element 21 when the head 23 presses on the tab 24.

A first resilient member 25 is arranged coaxially to the shaft 15 and is preferably constituted by a spring interposed between the perforated end of the first sleeve 16 and the wings of the head 23 of said shaft.

A second resilient member 26 is arranged coaxially to the tab 24 and is constituted by a spring interposed between the base of the second sleeve 17 and the wing of the head 23 of the shaft 15.

The device furthermore comprises at least one third resilient member 27 which is constituted by one or more springs interposed between the frame 6 or the shell 5 and the wings of the support 21 of the braking element 10.

A retention element 28, constituted by a raised portion protruding laterally to the frame 6, is also provided.

The use of the braking device is as follows: first of all, the first, second and third resilient members have such an elastic constant as to allow, when at rest, to support the braking element 10 so that the pad 22 does not interact with the ground.

The user can thus customize the position of the braking element by acting on the first rod member 8 and on the second rod member 9, varying their position with respect to the cylinder 11 and to the second bush 19, and can also vary the pre-loading of the springs 25 and 26 by mutually screwing and unscrewing the first sleeve 16 and the second sleeve 17.

The gap between the ends of the tab 24 and the head 23 allows the quarter 4 to rotate backwards without directly activating the braking element 10, thus allowing free oscillation without producing a braking action.

Furthermore, the presence of the first resilient member 25 allows to adjust the forward flexibility of the quarter 4.

The second resilient member 26 may also be suitable to adjust the inclination of said quarter, since said third resilient member 23 has a higher elastic constant.

Once all these adjustments have been performed, the user produces the braking action at a preset angle of backward rotation imparted to the rear quarter.

The various adjustments furthermore allow to compensate any wear of the pad 22.

It has thus been observed that the invention has achieved the intended aim and objects, a braking device having been obtained which can be activated by the user at a presettable angle of backward rotation imparted to the quarter; this can be achieved by producing the required setting of the useful length of the first and/or second rod members with respect to the support 21 and to the quarter 4.

Furthermore, both activation and deactivation of the braking element 10 are very simple, so as to allow to obtain a device which is structurally simple and easy to industrialize; the device can also be applied easily to known skates.

Figure 2:
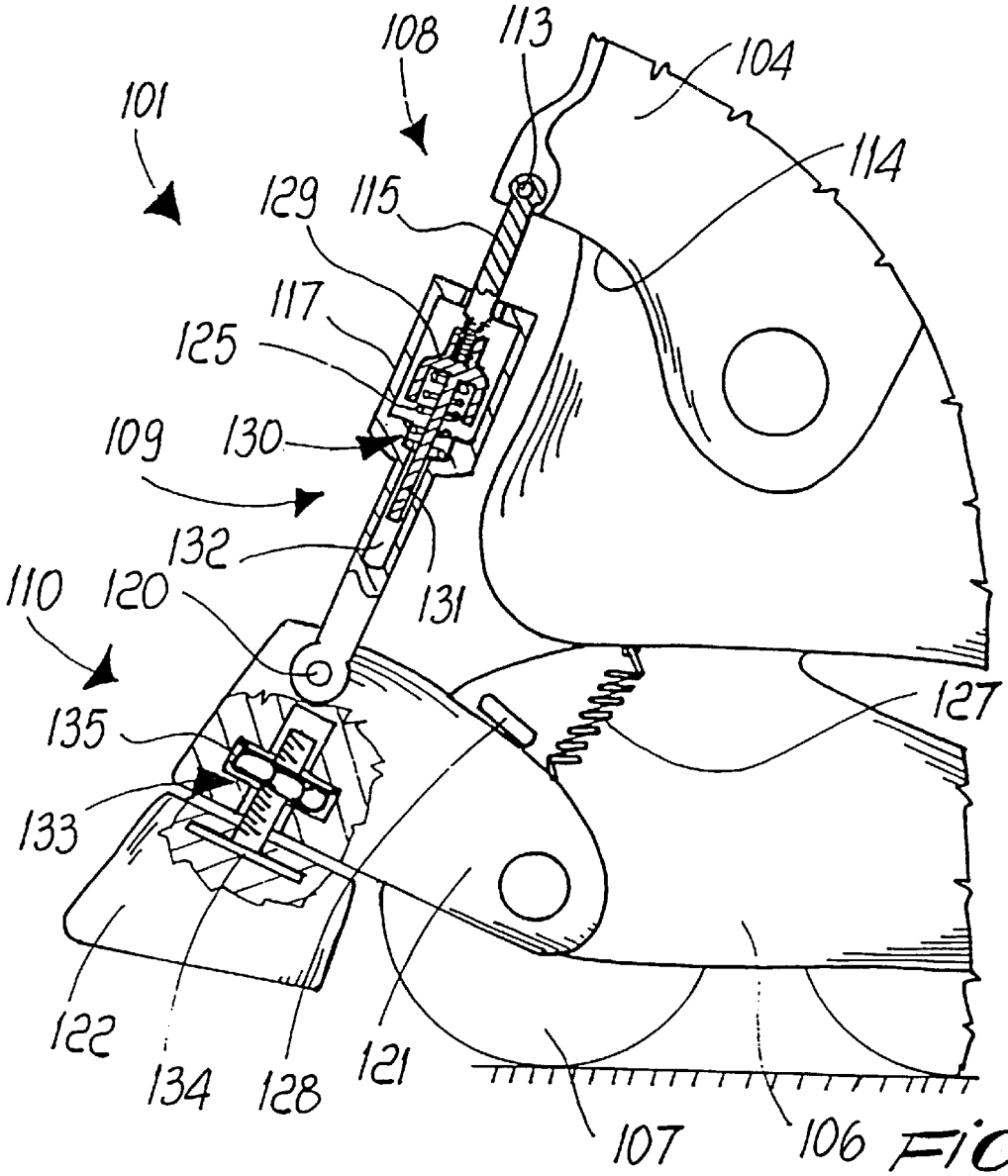
FIG. 2 is a view, similar to the preceding one, of a further embodiment of the device.
Figure 3:
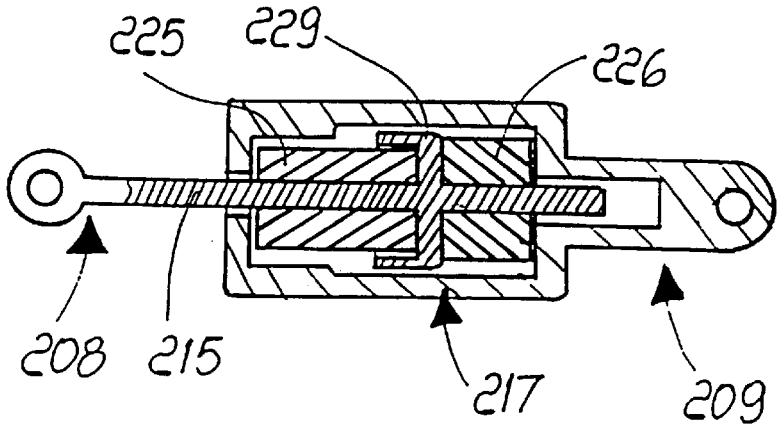
FIG. 3 is a sectional view, taken along a longitudinal plane, of the first and second rod member in another embodiment.

FIGS. 2 and 3 illustrate a further embodiment for a braking device 101 which comprises a first rod member 108 and a second rod member 109, both of which are coupled at their ends, by means of a first pivot 113 and a second pivot 120, respectively to the rear of the quarter 104 proximate to the lower perimetric edge 114 and to the support 121, the wings whereof are pivoted to the frame 106 or at the pivot of one of said wheels 107.

The first rod member 108 is constituted by a shaft 115 having a threaded end axially slideable inside a second sleeve 117 which is internally hollow and is rigidly coupled to the second rod member 109.

The complementarily threaded end of a third sleeve 129 is associated with the threaded end of the shaft 115; a first resilient member 125 is arranged inside said third sleeve 129 and is constituted by a spring which interacts by abutment at an adapted seat 130 formed axially at the base of the second sleeve 117 toward the braking element 110.

A means suitable to guide the telescopic movement between the first rod member 108 and the second rod member 109 protrudes axially with respect to the third sleeve 129; said means is constituted by a rod 131 freely slideable within an adapted cavity 132 connected to the seat 130.

In the illustrated embodiment, the device comprises means suitable to vary the mutual distance between the support 121 and the pad 122; said means are constituted by a screw 133 the head 134 whereof is embedded in the pad 122 and the threaded stem whereof interacts with a complementarily threaded nut 135 accommodated within the support 121.

In this case, too, the intended aim and objects are therefore achieved, a braking device having been obtained which allows to adjust the angle of backward inclination of the quarter 4 to achieve interaction of the pad 122 with the ground.

It is furthermore possible to control the backward rotation of the quarter, giving a controlled and cushioned rest during sports practice by virtue of the presence of an adapted third resilient member 127 the elastic constant whereof is greater than that of the first elastically deformable element 125.

The presence of the screw 133 allows to vary the position of the pad 122 according to its wear.

A further advantage of this further embodiment is constituted by the fact that the forward rotation of the quarter is not hindered by the connection with the braking element, since the rod 131 is freely slideable within the cavity 132.

Finally, there is a retention element 128 which protrudes from the frame 106 and interacts with the support 121.

FIG. 3 illustrates a further embodiment, wherein the first rod member 208 is again telescopically slideable with respect to the second rod member 209, which is again rigidly associated with a second sleeve 217 within which a shaft 215 is slidingly arranged. The shaft 215 has, inside the second sleeve 217, a third sleeve 229 for containing a first resilient member 225 and for supporting a second resilient member 226, both of which are contained within the second sleeve 217.

The use of these resilient members allows to achieve a shock-absorbing effect both for a forward inclination of the quarter and for a backward inclination thereof.

Figure 5:
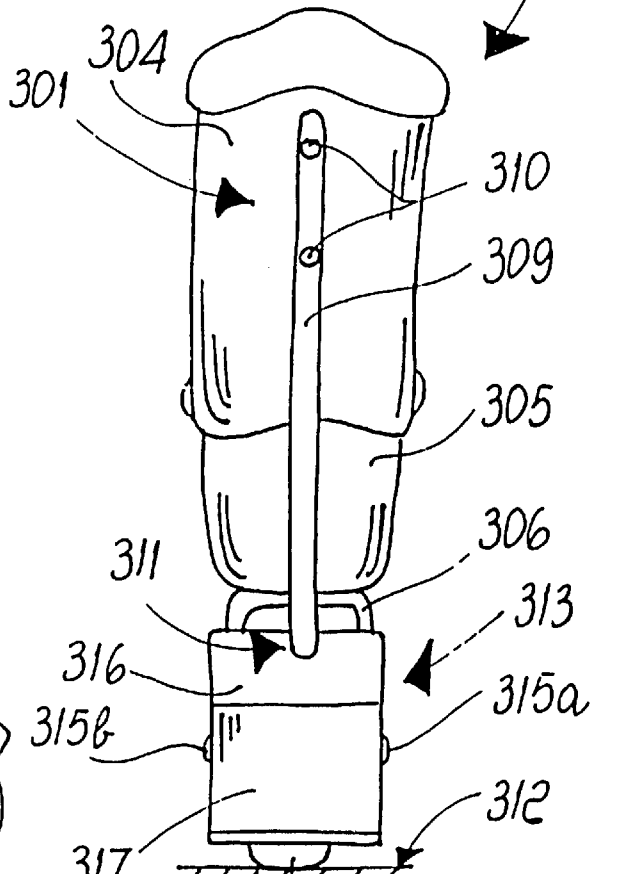
FIG. 5 is a rear view of the skate of FIG. 4.
Figure 4:
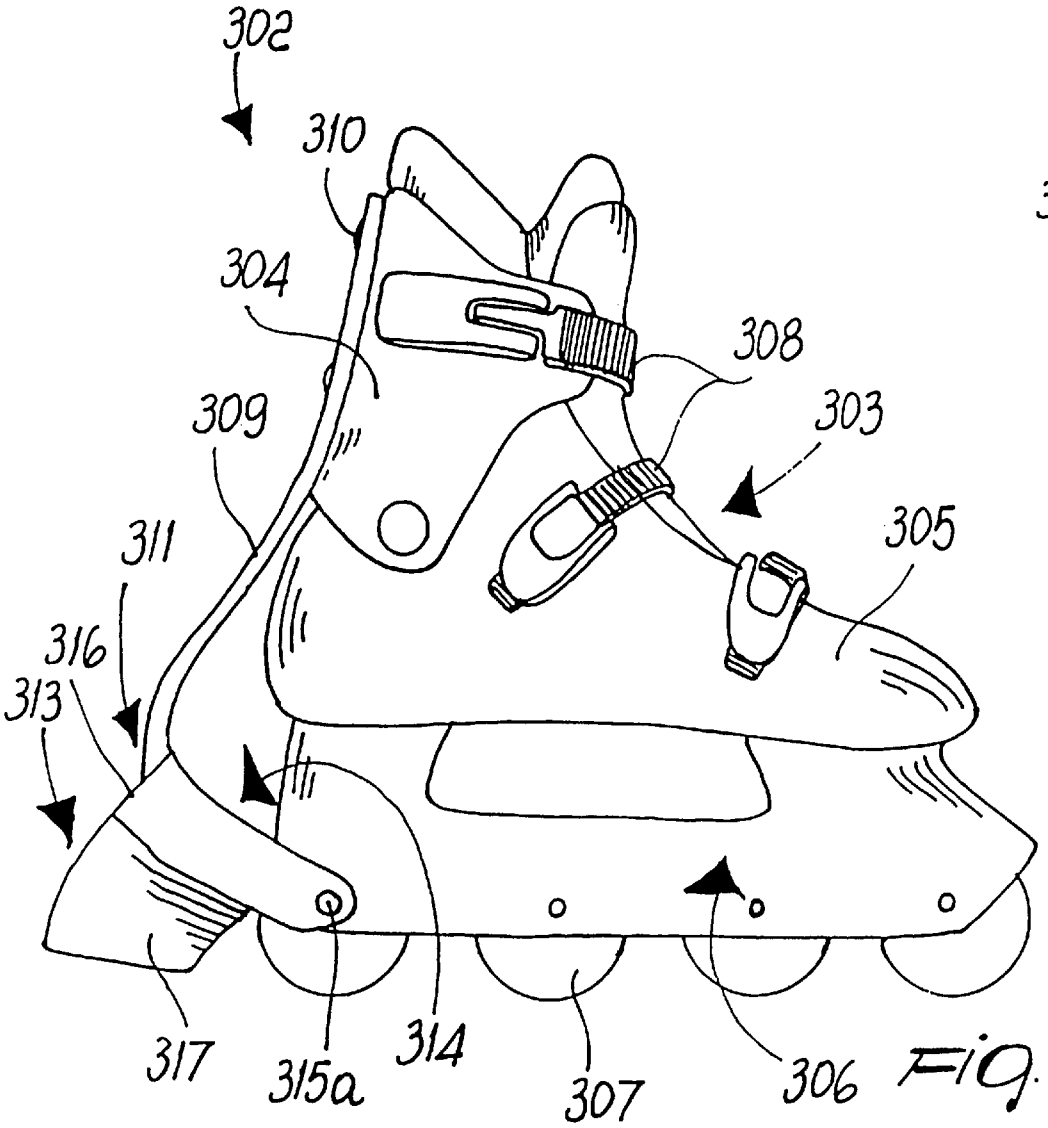
FIG. 4 is a side view of a roller skate according to a further aspect of the invention.
Figure 6:
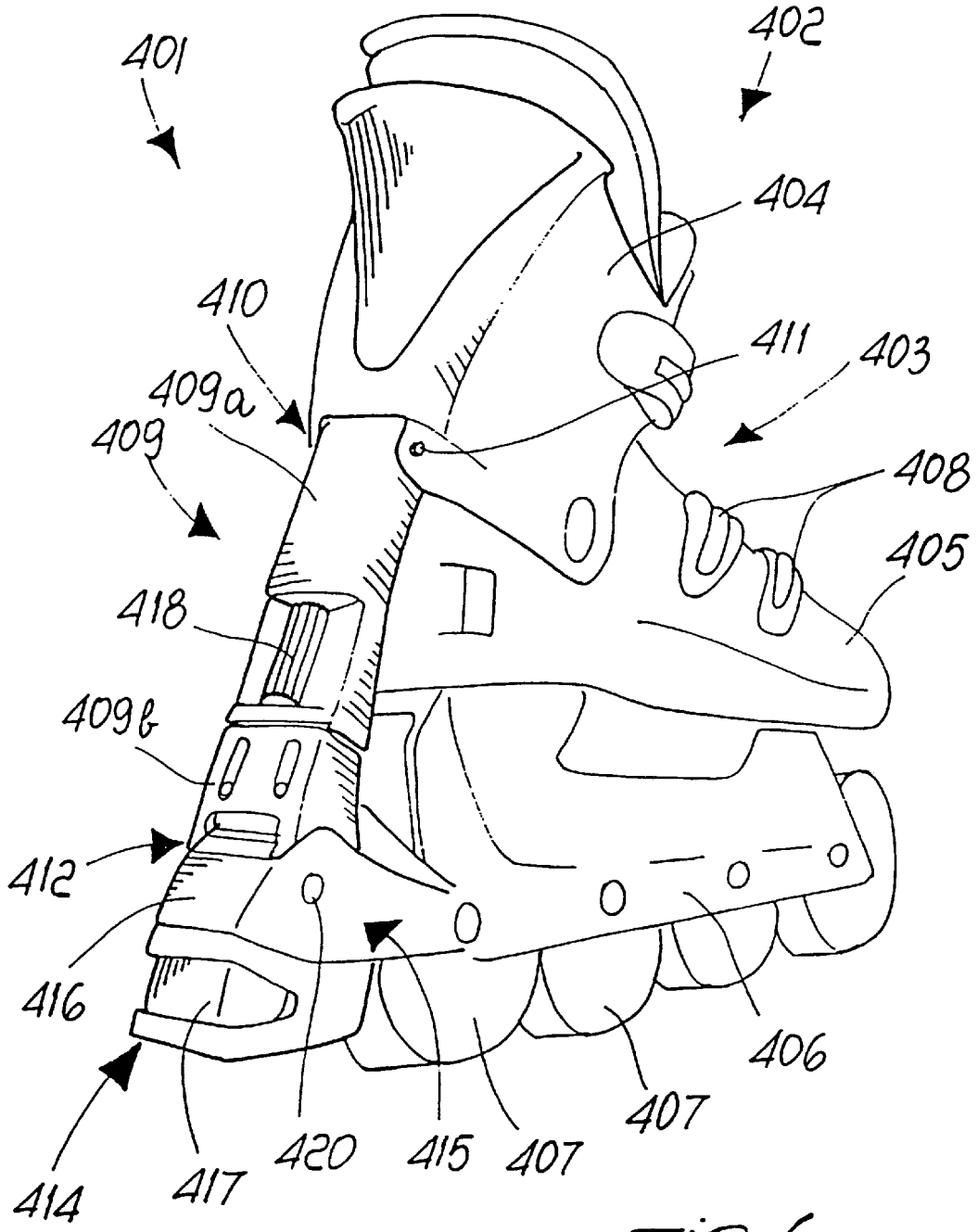
FIG. 6 is a rear perspective view of a skate provided with a braking device according to a fifth aspect of the invention.
Figure 7:
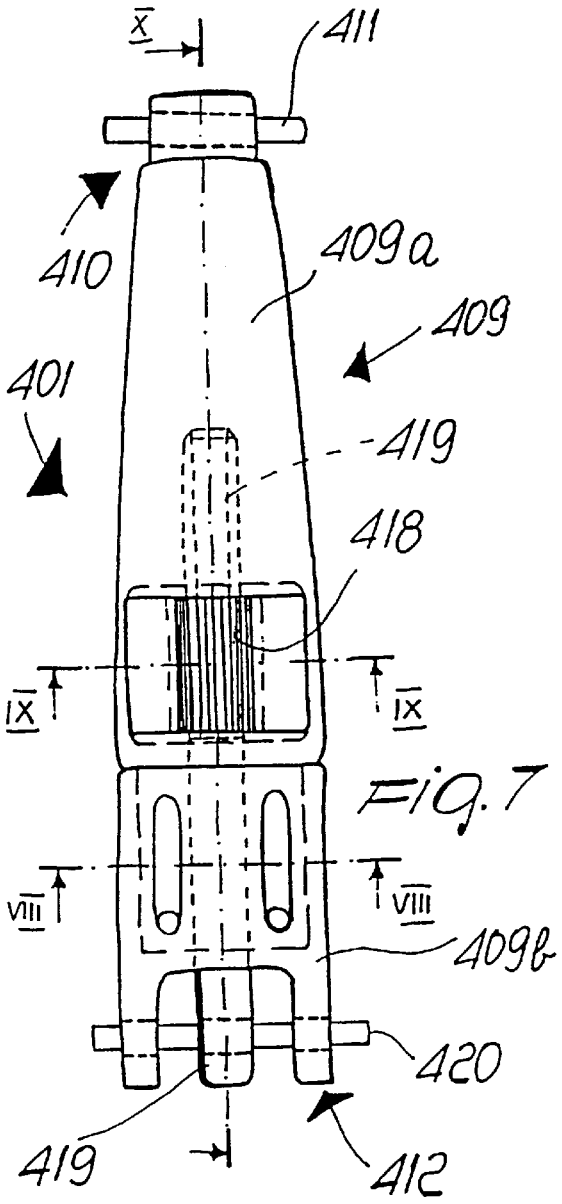
FIG. 7 is a detail front view of the rod member of the device of FIG. 6.
Figure 10:
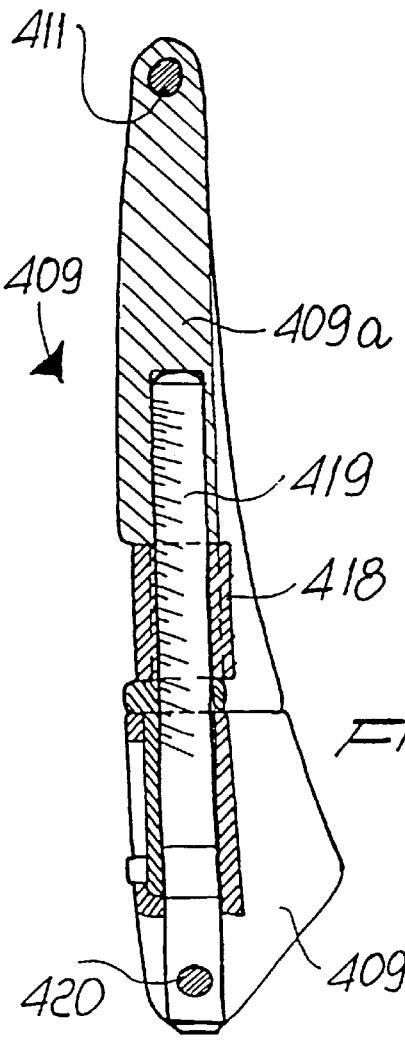
FIG. 10 is a sectional view according to the plane X—X of FIG. 7.
Figure 9:
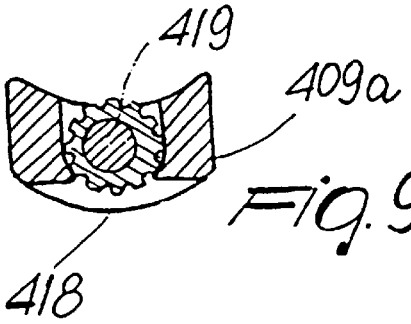
FIG. 9 is a sectional view according to the plane IX—IX of FIG. 7.
Figure 8:
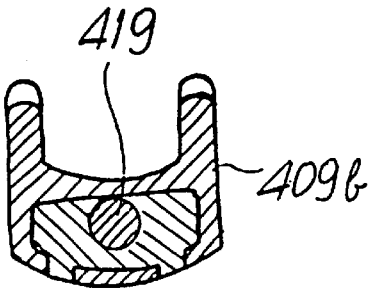
FIG. 8 is a sectional view according to the plane VIII—VIII of FIG. 7.
Figure 12:
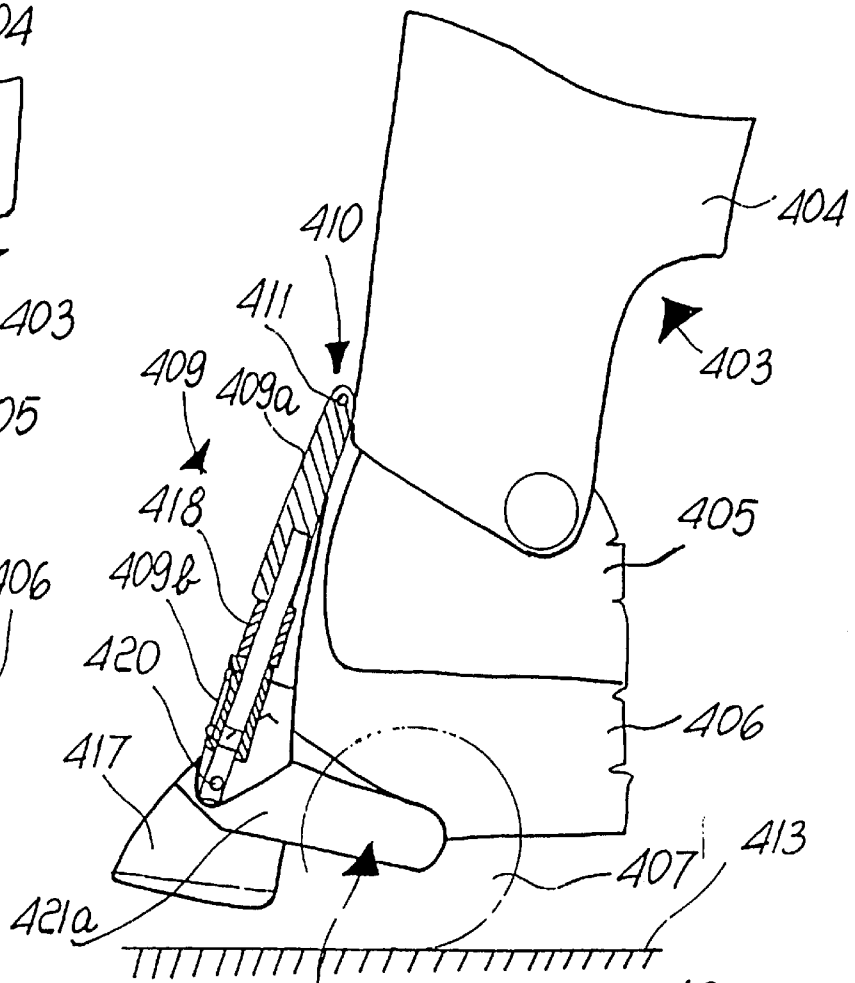
FIG. 12 is a view similar to the preceding one in the inactive position.
Figure 11:
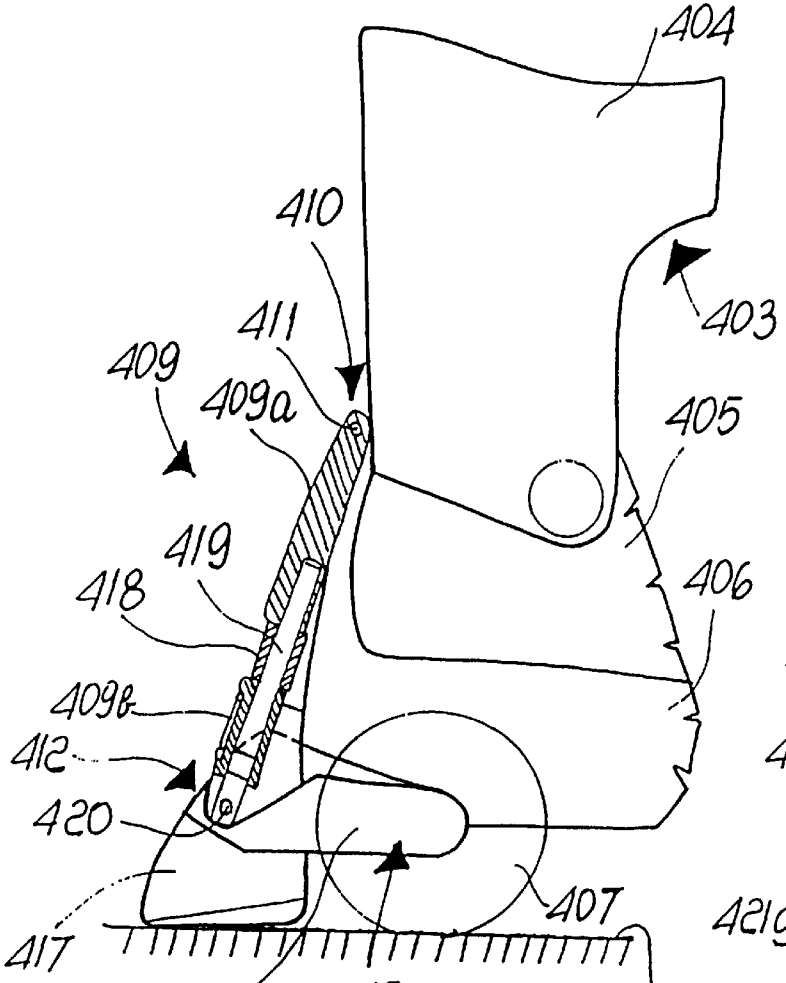
FIG. 11 is a partially sectioned side view of the skate of FIG. 6 in the braking position.
Figure 14:
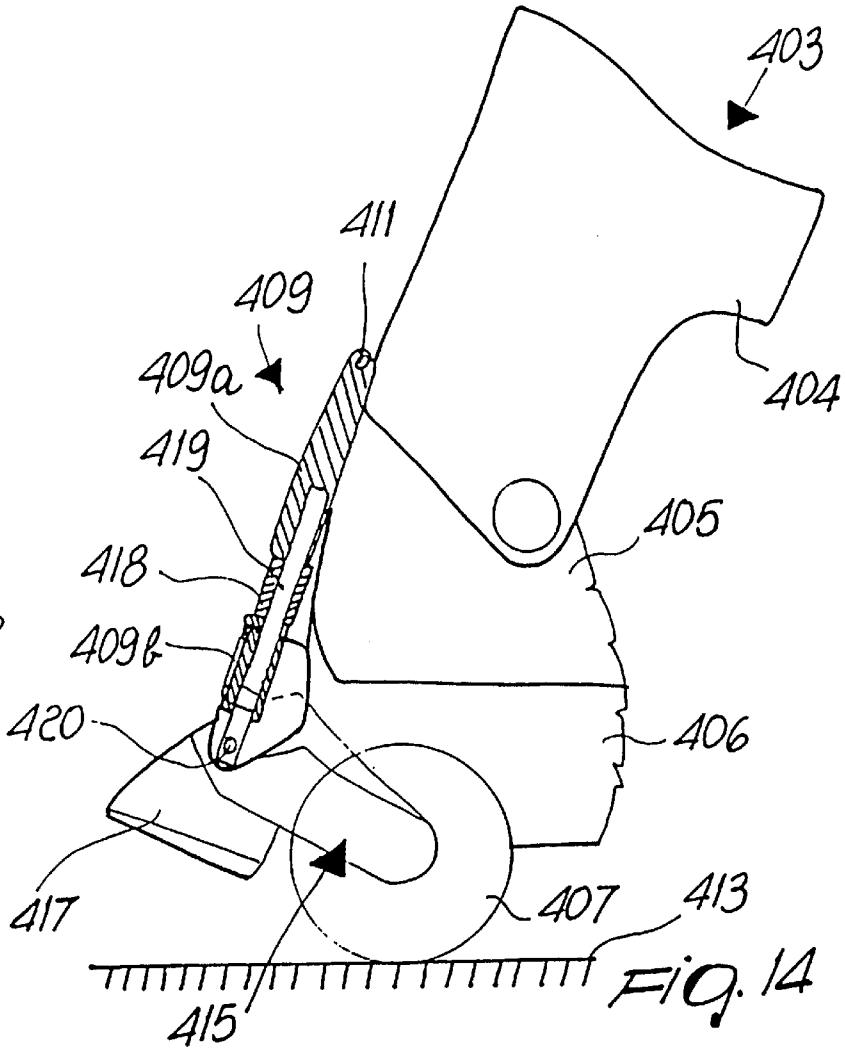
FIG. 14 is a view similar to the preceding one in the position of maximum forward flexing.
Figure 13:
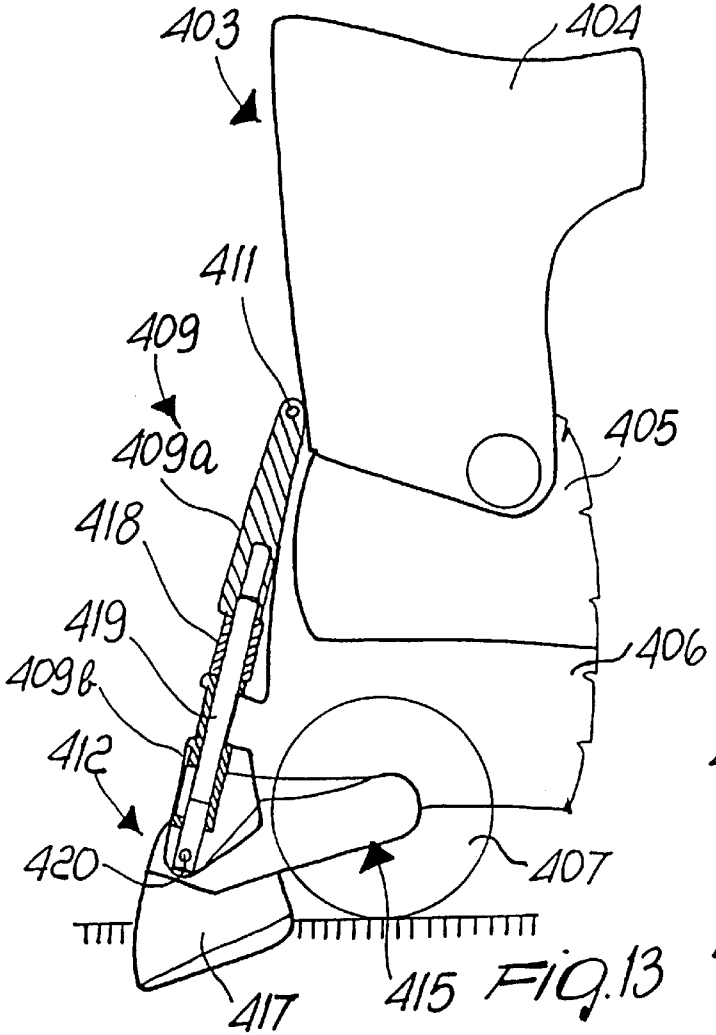
FIG. 13 is a view similar to the preceding ones in the braking position, wherein the threaded stem is completely extracted to compensate for pad wear.

With reference to FIGS. 4–5, the reference numeral 301 designates a braking device for a skate 302 according to a further aspect of the invention.

Said skates comprise an item of footgear 303 which is composed of a quarter 304, which wraps around the rear lateral region of the user's leg and is articulated to a shell 305. A frame 306 is associated with said shell in a downward region and supports one or more wheels, designated by the reference numeral 307, which are preferably mutually aligned.

Adapted fastening levers 308 may be applied to the quarter 304 and the shell 305.

The braking device comprises at least one rod member, generally designated by the reference numeral 309, which is arranged to the rear of the item of footgear 303 and is connected to the quarter 304 by means of one or more adapted fastening members, such as for example screws or rivets 310.

The rod member 309 is shaped complementarily to the quarter 304 and is arranged outside the shell 305; it therefore has a curved shape which is suitable to arrange its end 311, which faces toward the ground 312, in a region to the rear of the frame 306, so that it can be connected to a braking element 313 which is articulated to said frame 306 in an oscillating manner.

The braking element is constituted by a support 314 the wings whereof are pivoted, at their ends, to the frame 306 by means of studs or rivets or by means of the pivot of said wheel 315*a* and 315*b*, whereas the base 316 of the support 313 is connected to the end 311 of the rod member 309.

A pad 317, preferably made of rubber and suitable to interact with the ground, is furthermore associated with the support 314 in a downward region.

Use of the braking device is in fact as follows: by virtue of the connection of the end 311 of the rod member 309 to the base 316 of the support 314 of the braking element 313, which is rotatably pivoted to the frame 306, if the user imparts a backward rotation to the quarter 304, the end 311 of the rod member 309 moves 50 as to cause the pad to interact with the ground.

This interaction occurs only for a preset rotation imparted to the quarter 304 which, by virtue of the shape which can be given to the rod member 309 can thus be preset.

The user can in fact modify the shape of the rod member 309 to adjust the working length of the rod member and therefore to adjust the angle of inclination of the quarter 304 needed to brake.

This is done to allow interaction of the pad 317 with the ground 312 only when a given angle of backward rotation of the quarter 304 is exceeded, in order to avoid accidental braking actions.

When the user resumes him normal skating position, the end 311 of the rod member 309 rises simultaneously, and thus the pad disengages immediately from the ground.

It has been observed that the invention has achieved the intended aim and objects, a braking device having been achieved which can be activated by the user at a presettable angle of backward rotation of the quarter; this can be achieved by giving the required shape or length to the rod member.

With reference to FIGS. 6–14, the reference numeral 401 designates the braking device particularly usable for skates designated by the reference numeral 402.

Said skates comprise an item of footgear 403 composed of a quarter 404, which wraps around the rear lateral region of the user's leg and is articulated to a shell 405; a frame 406 is associated with said shell in a downward region and supports one or more wheels, designated by the reference numeral 407, which are preferably mutually aligned.

Adapted fastening levers 408 are applied to the quarter 404 and the shell 405.

The braking device comprises at least one rod member, generally designated by the reference numeral 409, which is arranged to the rear of the item of footgear 403 and is pivoted, at a first end 410, transversely to the quarter 404 by means of an adapted first pivot 411.

In the particular embodiment shown, the rod member 409 is composed of two portions or segments 409*a* and 409*b* which are mutually telescopically connected in order to allow to adjust the position of the pad 417 with respect to the ground 413, as explained hereafter.

The rod member 409 is sledeable with respect to the shell 405 and has a second end 412 which is not associated with the quarter 404, is directed toward the ground 413, and is articulated to the braking element 414 by means of a second pivot 420; said braking element 414 is in turn oscillatably articulated to said frame 406.

The braking element is constituted by a substantially C-shaped support 415, the wings 421*a* and 421*b* whereof are pivoted, at their ends, to the frame 406 by means of studs or rivets or by means of the pivot of a wheel 407; a pad 417, preferably made of rubber and suitable to interact with the ground, is associated with the support 415 proximate to the base 416.

There are also means for adjusting the mutual position of said at least one rod member and of said braking element; said means are constituted by an internally threaded cylinder 418 which is rotatably and longitudinally associated with said rod member in an adapted seat formed thereon.

A complementarily threaded stem 419 engages the thread of the cylinder 418, and one end of said stem is associated with the support 415 by means of the pivot 420, which interacts with the wings 421*a* and 421*b*, so as to allow to vary the distance of the pad from the ground.

Use of the braking device is in fact as follows: by virtue of the connection of the end of the rod ember 409 to the support 415 or of the connection of the stem 419 to said support 415, a backward rotation imparted by the user to the quarter 404 is matched by a movement of the second end 412 of the rod member 409 which moves the pad, associated with the braking element 414 which is in turn rotatably pivoted to the frame 406, so that it interacts with the ground.

This interaction occurs only for a preset rotation imparted to the quarter 404, said rotation being set during design to ensure the correct and safe use of the skate, thus avoiding the occurrence of accidental braking actions for minimal angles of backward rotation of the quarter.

By virtue of the possibility of adjusting the mutual distance between the pad 417 and the ground 413 by means of the cylinder 418, it is possible to determine the conditions required to obtain the braking action and thus determine them according to individual physical characteristics or to the particular use of the skate or to the wear of the pad.

This allows to select the angle of backward rotation of the quarter 404 beyond which interaction of the pad 417 with the ground 413 begins, in order to both avoid accidental braking actions while skating and compensate the unavoidable wear of the pad 417, keeping constant the braking conditions of the user.

Once the user returns to the normal skating position, the second end 412 of the rod member 409 rises simultaneously and the pad immediately disengages from the ground.

Figure 16:
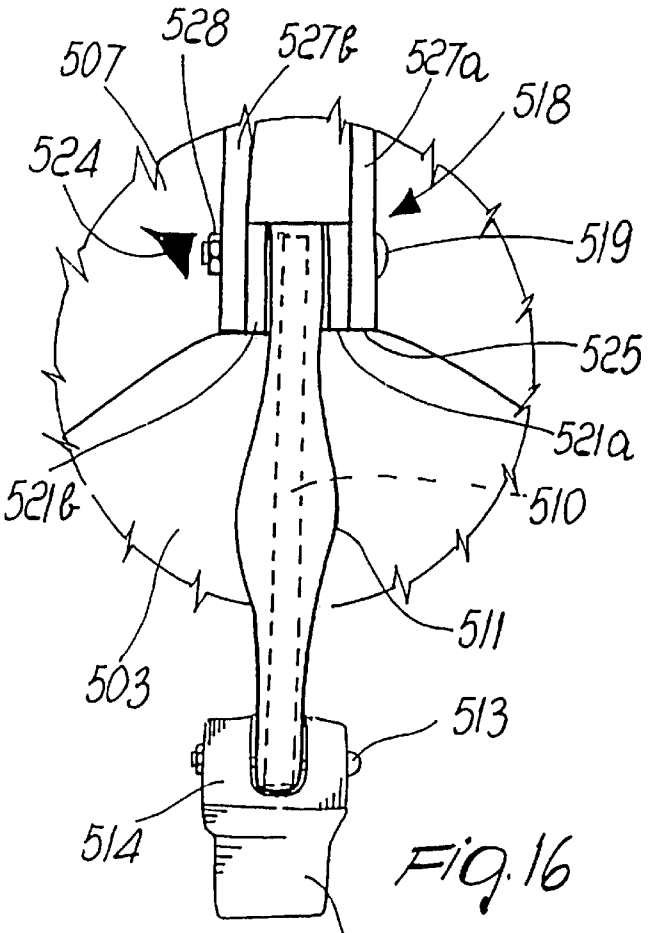
FIG. 16 is a partial rear view of the skate of FIG. 15.
Figure 15:
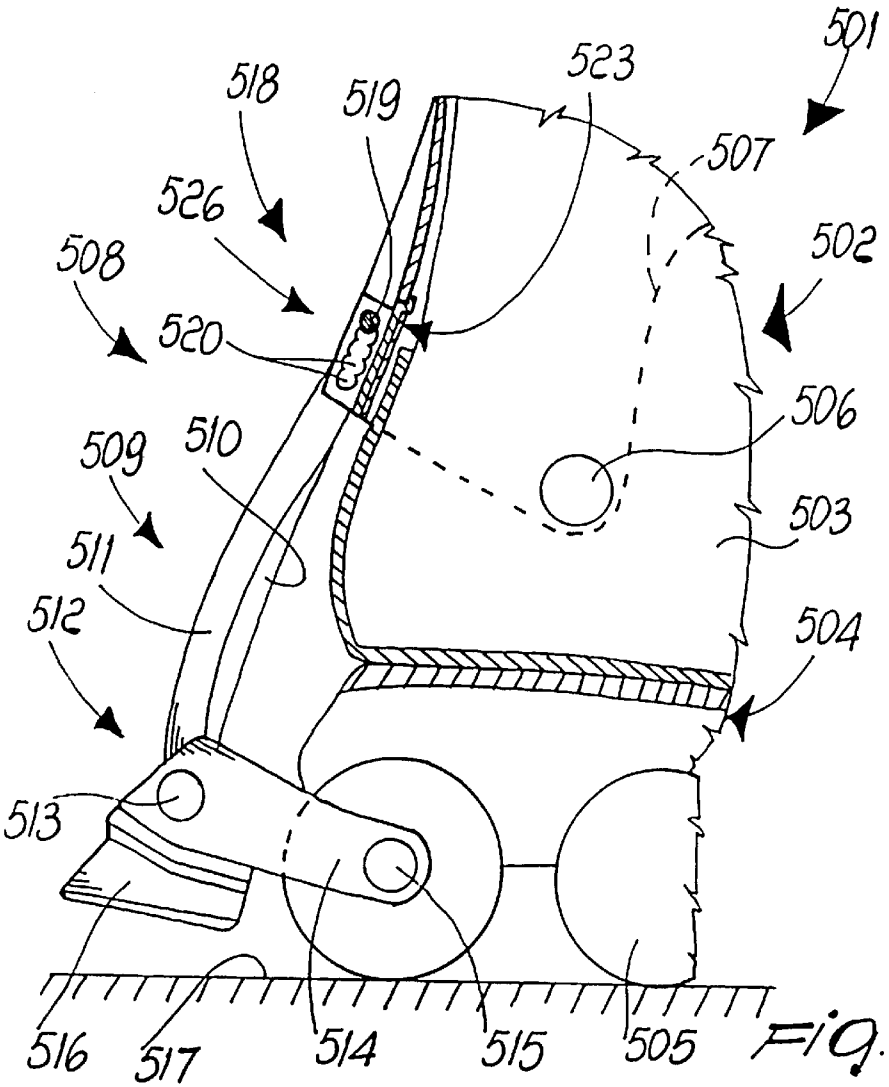
FIG. 15 is a partially sectioned side view of the rear portion of a skate according to a sixth aspect of the invention.

With reference to FIGS. 15–16, the reference numeral 501 designates a skate which is constituted by an item of footgear 502 composed of a shell 503 which is associated, in a downward region, with a frame 504 for two or more wheels 505 which are arranged in pairs parallel to each other or in a line, as shown in FIG. 15.

A quarter 507 is articulated at the shell 502 by means of studs 506, and interacts with means suitable to allow closure of said quarter in order to fasten the foot of the user.

The braking device, generally designated by the reference numeral 508, comprises a rod member 509 advantageously composed of a rigid strut 510, preferably made of steel, with which a covering 511, preferably made of plastic material, is associated.

At one end, said strut 510 and said covering 511 surmount, or are associated with, a support 514, for example by means of a first pivot 513; said support 514 is articulated, in an oscillating manner, to the frame 504 or to the second pivot 515 of one of the wheels 505; a pad 516 is associated with said support and is directed toward the ground 517; this assembly constitutes a braking element for the skate.

The strut 510 and the covering 511 have a second end 518 which interacts with means for adjusting the position at least of the rod member 509 with respect to the quarter 507; said means are constituted by a third pivot 519 which is detachably associable at an adapted first seat formed on said second end 518 of the strut 510 and/or of the covering 511.

Said third pivot 519 can furthermore be arranged at one of a plurality of complementarily shaped second seats 520 which are formed sequentially and along the same axis at the wings 521*a* and 521*b* of a rigid base 523, preferably made of steel, which is U-shaped and is associated at the rear region 524 of the quarter 507 proximate to its lower perimetric edge 525.

Advantageously, the wings 521*a* and 521*b* are arranged within an adapted recess 526 formed in a rearward region of the quarter 507; adapted holes for the passage of the third pivot 519 at the desired seat among the second seats formed on the strut 510 are provided on the lateral walls 527*a* and 527*b* of said recess 526.

Use of the device is thus as follows: by means of the third extractable pivot 519, the user can place the second end 518 of the rod member 509 at the desired seat among the seats 520 formed on the wings 521*a* and 521*b* of the base 523.

In this manner, the user can select the distance between the lower perimetric edge 525 of the quarter 507 and the support 514 of the pad 516.

Therefore, according to specific requirements such an morphological configurations or the type of sport practiced, the user can select the interaction of the pad 516 with the ground 517 according to the desired angle of backward tilt of the quarter 507, and thus achieve braking.

The braking device is also very simple and safe in use; in fact the third pivot 519 can be locked in the preselected position by associating it, for example, with an adapted locking nut 528.

The number and arrangement of the seats 520 may of course vary according to the specific requirements.

Figure 18:
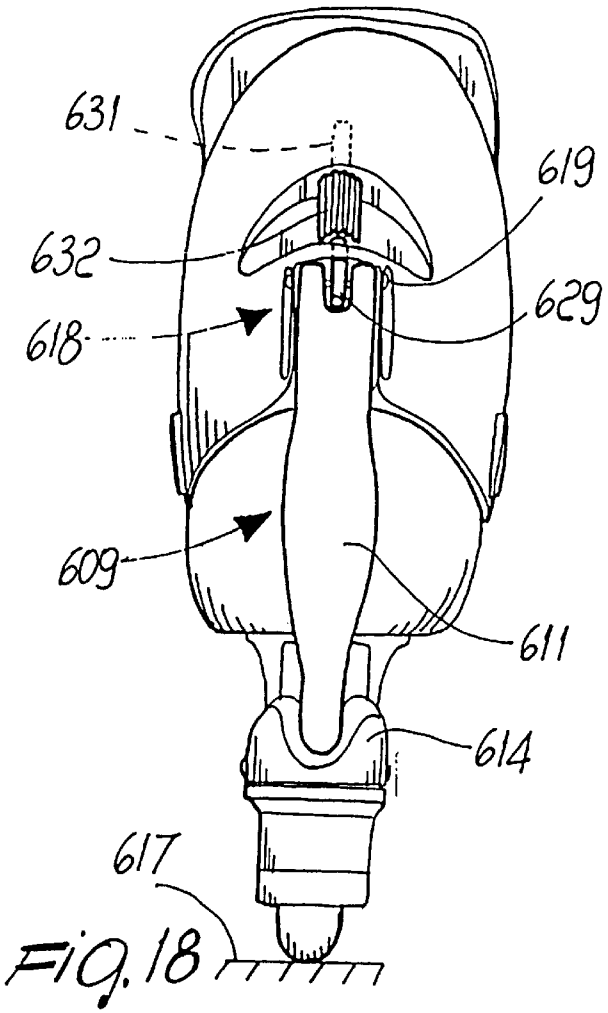
FIG. 18 is a partial rear view of the skate of FIG. 17.
Figure 17:
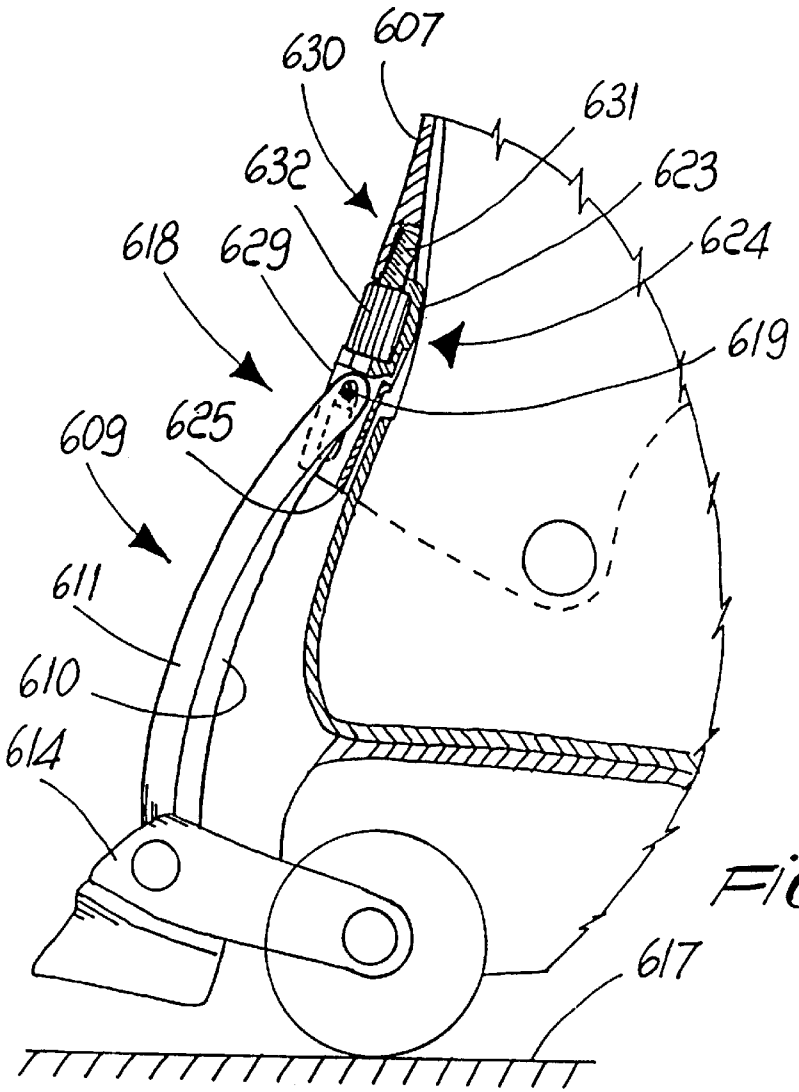
FIG. 17 is a partially sectioned side view of the rear portion of a skate according to a seventh aspect of the invention.

Furthermore, as shown in FIGS. 17 and 18, the means for adjusting the mutual position of the quarter 607 and of the second end 618 of the rod member 609 may be again constituted by a third pivot 619 which is pivoted at least at the strut 610 and possibly at the covering 611, said third pivot 619 affecting an adapted through seat formed on the head 629 of a screw 630.

Said screw comprises a threaded stem 631 with which a complementarily threaded sleeve 632 engages; said sleeve is rotatably associated at an adapted base 623 which is rigidly coupled in the rear region 624 of the quarter 607 proximate to its lower perimetric edge 625.

Operation in this embodiment entails that a rotation imparted to the sleeve 632 is matched by an axial movement for the threaded stem 631 of the screw 630; in this manner, the head 629 actuates the movement of the third pivot 619 and consequently varies the angle of the support 614 with respect to the ground 617.

Figure 19:
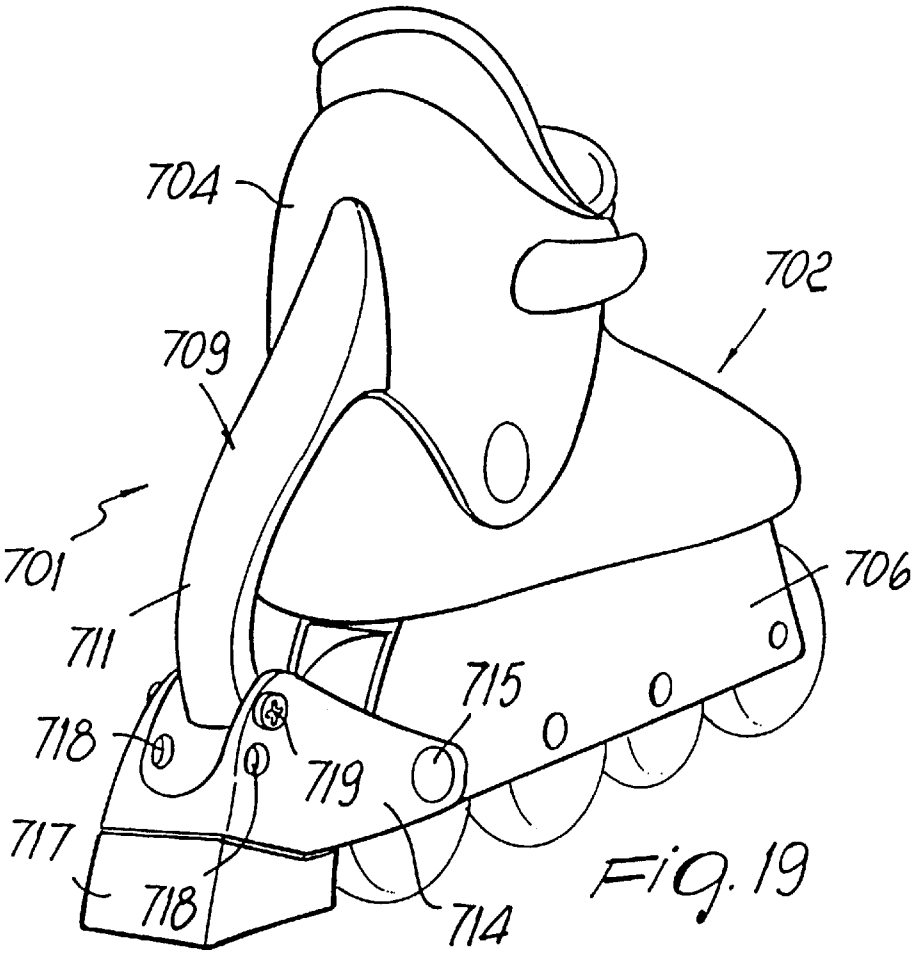
FIG. 19 is a rear perspective view of a skate according to an eighth aspect of the invention.

FIG. 19 shows a skate 702, according to a further aspect of the invention, comprising a braking device 701 which is constituted by a rod member 709 having an upper end connected with the quarter 704 and a lower end 711 connected to a brake support 714. The brake 714 is pivoted to the skate frame 706, at pivot 715, and supports a pad 717.

The brake support 714 also has a series of vertically arranged holes 718 adapted to engage a rod pivot 719 associated with the lower end of the rod member 709. It can be easily seen that the braking action can be varied by arranging the rod pivot 719 in different holes 718. Only two different holes 718, corresponding to two different braking positions, are illustrated in FIG. 19, it is however obvious that the number of holes may change according to the requirements.

Figure 20:
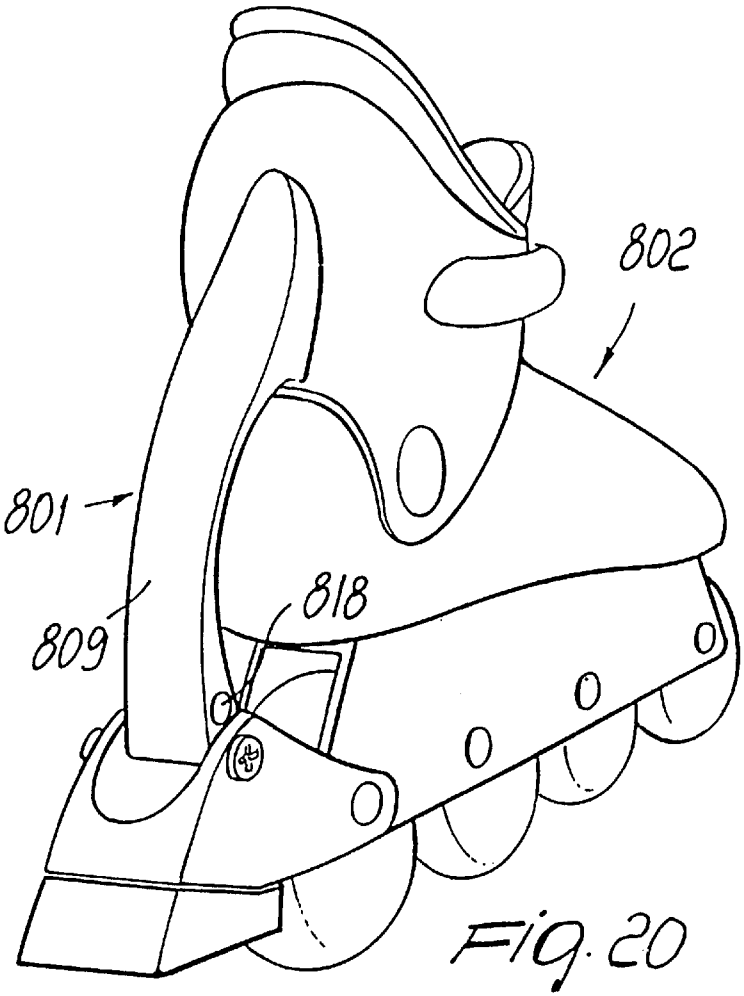
FIG. 20 is a rear perspective view of a skate according to a ninth aspect of the invention.

FIG. 20 shows a skate 802 having a slightly modified braking device 801, wherein the series of holes 818 is provided at the lower end of the rod member 809.

A further modified braking device, which is not illustrated in the drawings, may have two series of adjusting holes provided respectively at the lower end of the rod member and at the brake support.

Naturally, the materials and the dimensions which constitute the individual components of the invention may also be the most pertinent according to the specific requirements.

We claim:

1. In a skate comprising a base arranged to support the foot of a user, a longitudinally-extending frame associated with said base and adapted to support a plurality of wheels, and a braking element positioned rearwardly with respect to said frame and supported relative to said frame for upward and downward movement between a first position in which said braking element is spaced upward above the ground and a second position in which said braking element engages the ground, that improvement comprising;

an upper support adapted to be secured relative to the leg of a user at a position above the ankle of the user when the foot of the user is in engagement with said base such that said upper support is movable generally forwardly and rearwardly relative to said frame in response to pivoting of the leg of the user about the ankle region of the user; and, an actuator disposed rearwardly of said upper support and rearwardly of a forward portion of said braking element, and extending generally longitudinally between said upper support and said braking element, said actuator being interconnected between said upper support above said ankle of said user and said braking element such that said actuator moves generally downwardly and causes said braking element to move towards the ground when said upper support is moved rearwardly and moves generally upwardly and causes said braking element to move away from the ground when said upper support is moved forwardly.

2. The skate of claim 1 wherein said upper support is connected to said skate for pivotal movement relative to said base.

3. The skate of claim 1 wherein said base comprises a shell arranged to receive the foot and ankle region of a user and said upper support comprises a quarter mounted for pivotal movement relative to said shell.

4. The skate of claim 3 wherein an upper end of said actuator is connected to the rear portion of said quarter and a lower end of said actuator is connected to said braking element.

5. The skate of claim 1 wherein the working length of said actuator between the points at which said actuator is connected to said upper support and to said braking element is adjustable.

6. The skate of claim 1 wherein said braking element is pivotally connected to said frame and includes a brake support having a pivot end pivotally attached to said frame and an extending portion extending rearwardly, with respect to said frame, from said pivot end, and wherein said actuator is positioned rearwardly of said pivot end.

7. The skate of claim 6 wherein the working length of said actuator between said upper end thereof and said lower end thereof is adjustable.

8. In a skate comprising a shell arranged to receive the foot and ankle region of a user, a longitudinally-extending frame associated with said base and adapted to support a plurality of wheels, and a braking element positioned rearwardly with respect to said frame and supported relative to said frame for upward and downward movement relative to said frame between a first position in which said braking element is spaced upward above the ground and a second position in which said braking element engages the ground, that improvement comprising:

an upper support connected to said skate for pivotal movement relative to said shell about a first axis and adapted to be secured relative to the leg of a user at a position above the ankle of the user when the foot of the user is in engagement with said base such that said upper support is movable generally forwardly and rearwardly relative to said frame in response to pivoting of the leg of the user about the ankle region of the user; and, an actuator disposed rearwardly of said upper support and rearwardly of a forward portion of said braking element, and extending generally longitudinally between said upper support and said braking element, said actuator being responsive to rearward movement of said upper support to cause said braking element to move towards said second position, and permitting said braking element to move towards said first position upon forward movement of said upper support.

9. The skate of claim 8 wherein the working length of said actuator between said upper end thereof and said lower end thereof is adjustable.

10. The skate of claim 8 wherein said braking element is pivotally connected to said frame and extends rearwardly of said frame for pivotal movement relative to said frame about a second axis between said first position and said second position, said actuator being positioned rearwardly of said second axis.

11. The skate of claim 10 wherein said braking element comprises:

a braking support having a pivot end pivotally connected to said frame and an extending portion extending rearwardly, with respect to said frame, from said pivot end; and, at least one brake pad supported by said brake support and having a braking surface adapted to interact with the ground.

12. The skate of claim 10 wherein said actuator is positioned rearwardly of said first axis.

* * * * *